United States Patent [19]

Hight

[11] Patent Number: 4,732,693

[45] Date of Patent: Mar. 22, 1988

[54] SOAP-NONIONIC DETERGENT COMPOSITIONS CONTAINING A CELLULOSE ETHER ANTI-REDEPOSITION AGENT

[75] Inventor: Andrew T. Hight, South Wirral, England

[73] Assignee: Lever Brothers Company, New York, N.Y.

[21] Appl. No.: 886,589

[22] Filed: Jul. 16, 1986

[30] Foreign Application Priority Data

Jul. 29, 1985 [GB] United Kingdom ..... 8519046

[51] Int. Cl.[4] ..... C11D 3/22; C11D 3/37; C11D 9/26; C11D 10/04

[52] U.S. Cl. ..... 252/132; 252/109; 252/174.17; 252/174.21; 252/DIG. 15

[58] Field of Search ..... 252/132, 174.17, 174.21; 427/393.4

[56] References Cited

U.S. PATENT DOCUMENTS

| | | | |
|---|---|---|---|
| 3,956,160 | 5/1976 | Watanabe | 252/132 |
| 4,020,015 | 4/1977 | Bevan | 252/544 |
| 4,048,433 | 9/1977 | Burns | 252/174.17 |
| 4,100,094 | 7/1978 | Burns | 252/132 |
| 4,127,495 | 11/1978 | Swinson | 252/174.17 |
| 4,138,352 | 2/1979 | Teot | 252/135 |
| 4,411,803 | 10/1983 | Wixon | 252/8.75 |
| 4,441,881 | 4/1984 | Ruppert | 8/137 |
| 4,532,067 | 7/1985 | Padron et al. | 252/174.17 |
| 4,564,463 | 1/1986 | Secemski | 252/174.17 |
| 4,566,993 | 1/1986 | Secemski | 252/559 |

FOREIGN PATENT DOCUMENTS

| | | |
|---|---|---|
| 2256194 | 5/1974 | Fed. Rep. of Germany . |
| 2251133 | 11/1976 | Fed. Rep. of Germany . |
| 715149 | 3/1973 | South Africa . |
| 646088 | 11/1950 | United Kingdom . |
| 1414064 | 11/1975 | United Kingdom . |
| 1460646 | 1/1977 | United Kingdom . |
| 1498520 | 1/1978 | United Kingdom . |
| 1534641 | 12/1978 | United Kingdom . |

*Primary Examiner*—Dennis Albrecht

*Attorney, Agent, or Firm*—Milton L. Honig; James J. Farrell

[57] ABSTRACT

A soap based detergent composition for washing fabrics comprises an ethoxylated nonionic detergent active compound and a cellulose ether in addition to the soap, with the ratio of the soap to the nonionic active being from 1:1 to 10:1. Up to 10% phosphate builder may be present. The combination of the nonionic and the cellulose ether reduces redeposition of soil compared with other redeposition agents.

6 Claims, No Drawings

SOAP-NONIONIC DETERGENT COMPOSITIONS CONTAINING A CELLULOSE ETHER ANTI-REDEPOSITION AGENT

TECHNICAL FIELD

The invention relates to detergent compositions, in particular to products comprising soap, a nonionic detergent active compound and a cellulose ether, which products exhibit improved low temperature solubility, particularly for saturated soaps, and a remarkably low level of soil redeposition especially under poorly built conditions when employed in the washing of fabrics.

BACKGROUND & PRIOR ART

Soaps have long been used for the washing of fabrics. More recently, soaps have been used far less frequently as the principle detergent active ingredient in modern fabric washing products. This is because difficulties have been experienced in dispersing and dissolving such products containing soap as the principle active ingredient, when employed in the washing of fabrics particularly at low wash temperatures. Furthermore, when such products have been employed in the washing of fabrics in hard water, in poorly built conditions, poor cleaning of the fabrics has resulted. This is because soil washed from the fabrics in such hard water conditions and suspended or dispersed in the wash liquor, can readily be redeposited onto the fabric, thereby interfering with the cleaning of the washed fabrics.

Cellulose ethers have previously been employed as anti-redeposition agents in detergent compositions containing nonionic and/or anionic non-soap detergent actives, but not where soap is a principle component of that composition.

It will be appreciated that in addition to its detersive activity, soap can also function as a builder by reducing the calcium ion concentration of hard water. This attribute can be of particular value in those territories or regions of the world where environmental pressures are forcing manufacturers to reduce the amount of the more conventional phosphate builders that they employ in detergent products. Hence, the present invention is particularly applicable to the formulation of low or zero phosphate products for use at low wash temperatures.

It has been proposed in British patent No. 1 534 641 (Unilever) to employ in the washing of fabrics, a powdered composition comprising from 5 to 15% by weight of an ethoxylated alcohol nonionic surfactant, and up to 0.25% by weight of a cellulose ether soil release agent. Optionally, up to 3% by weight of a water-soluble soap can also be present in the formulation as an aid for reducing the bulk density of the spray-dried powder described in this reference. These powdered compositions also preferably contain a substantial amount of sodium tripolyphosphate as a builder, typically between 30 and 40%, the weight ratio of this phosphate to the nonionic surfactant being at least 3:1.

We have now discovered that problems inherent in the use of detergent compositions containing soap as a principle detergent active compound ingredient, can be resolved by incorporation in such compositions of a special nonionic detergent active compound and a cellulose ether, especially when conventional phosphate builders are present in only a small amount or are omitted altogether from the composition.

DEFINITION OF THE INVENTION

Accordingly, the invention provides a detergent composition comprising:

(i) from 5 to 50% by weight of soap;

(ii) from 5 to 25% by weight of ethoxylated nonionic detergent active compound;

(iii) from 0.05 to 5% by weight of a cellulose ether; and (iv) from 0 to 10% by weight of a phosphate builder;

the weight ratio of soap to nonionic detergent active compound being from 1:1 to 10:1.

DISCLOSURE OF THE INVENTION

The Soap

The detergent composition according to the invention comprises, soap, that is one or more water-soluble salts of medium to long chain fatty acids, which are preferably saturated.

These salts include not only the usual alkali metal salts of such fatty acids, but also the organic salts which can be formed by complexing fatty acids with organic nitrogen-containing materials such as amines and derivatives thereof. Usually, the soap comprises salts of higher fatty acids containing from 8 to 24 carbon atoms, preferably from 10 to 20 carbon atoms in the molecule, or mixtures thereof.

Preferred examples of fatty acid salts include sodium stearate, sodium palmitate, sodium salts of tallow, coconut oil and palm oil fatty acids and complexes between stearic and/or palmitic fatty acid and/or tallow and/or coconut oil and/or palm oil fatty acids with water-soluble alkanolamines such as ethanolamine, di- or triethanolamine, N-methylethanolamine, N-ethylethanolamine, 2-methylethanolamine and 2,2-dimethyl ethanolamine and N-containing ring compounds such as morpholine, 2'-pyrrolidone and their methyl derivatives.

Mixtures of fatty acid salts can also be employed.

Particularly preferred are the sodium and potassium salts of the mixed fatty acids derived from coconut oil and tallow, that is sodium and potassium tallow and coconut soap.

The amount of soap to be employed in compositions according to the invention is from 5 to 50%. Preferably at least 10% by weight of soap is used. The upper level of soap is preferably 45% by weight. Ideally the level of soap is from 20 to 35% by weight of the composition.

Nonionic Detergent Active Compound

The detergent composition according to the invention also comprises an ethoxylated nonionic detergent active compound. The nonionic detergent active compounds which are suitable are straight or branched $C_7$ to $C_{20}$ primary or secondary alcohols ethoxylated with from 3 to 25 moles of ethylene oxide per mole of alcohol, or mixtures thereof.

Preferred ethoxylated nonionic detergent active compounds are the $C_7$ to $C_{15}$ primary alcohols ethoxylated with from 3 to 11 moles of ethylene oxide per mole of alcohol.

The amount of ethoxylated nonionic detergent active compound to be employed in compositions according to the invention is from 5 to 25%, preferably from 7 to 15%, by weight of the composition.

The weight ratio of soap to nonionic detergent active compound in the detergent compositions according to the invention is from 1:1 to 10:1. Preferably, this weight ratio is from 2:1 to 5:1.

The Cellulose Ether

The detergent composition according to the invention also comprises a cellulose ether which is intended to function as a soil release agent and also to prevent or at least reduce the amount of released soil from redepositing on fabric during a laundry washing process. Suitable cellulose ethers are those which are water-soluble, particularly those which have a higher water-solubility at low wash temperatures than at high wash temperatures.

The cellulose ethers are preferably alkyl or alkyl/hydroxyalkyl cellulose derivatives in which the average number of substituent groups per anhydroglucose unit is from 1.5 to 3.0, preferably from 2.0 to 3.0. There should be an average of at least 1.0, preferably from 1.0 to 2.5, and most preferably from 1.5 to 2.1 of substituent groups per anhydroglucose unit. The alkyl groups should contain from 1 to 4, preferably from 1 to 3 carbon atoms, and the hydroxyalkyl groups should contain from 2 to 4, preferably from 2 to 3 carbon atoms. Particularly preferred alkyl groups are methyl and ethyl, and the preferred hydroxyalkyl groups are hydroxyethyl and hydroxypropyl. Propyl, butyl and hydroxybutyl groups may also be present. When the alkyl group is methyl, it is preferred that the hydroxyalkyl group is hydroxyethyl, although it will be appreciated that cellulose ethers having other combinations of alkyl and hydroxyalkyl groups may be used if desired. Particularly preferred cellulose ethers for use in accordance with the invention are methyl hydroxyethyl celluloses having an average of from 1.5 to 1.6 methyl groups per anhydroglucose unit and an average of from 0.5 to 0.6 hydroxyethyl groups per anhydroglucose unit.

Many of these cellulose ethers are available commercially, and others can readily be prepared by simple chemical procedures. For example, a methyl hydroxyethyl cellulose derivative can be prepared by reacting cellulose with dimethyl sulphate and then with ethylene oxide.

Particularly preferred examples of cellulose ethers are given in the following table in which the average number of alkyl and hydroxyalkyl groups is given:

TABLE 1

| Example | Cellulose derivative | Average number of: alkyl groups | Average number of: hydroxyalkyl groups |
|---|---|---|---|
| A | Methyl hydroxypropyl cellulose (METHOCEL J12HS: Dow Chemical Corpn.) | 1.8 | 1.0 |
| B | Methyl hydroxypropyl cellulose (METHOCEL 60HG50: Dow Chemical Corpn.) | 1.6 | 0.3 |
| C | Methyl hydroxypropyl cellulose (CELACOL HPM 450: British Celanese Ltd.) | 1.9 | 0.1 |
| D | Methyl hydroxypropyl cellulose (CELACOL HPM 30,000: British Celanese Ltd) | 1.8 | 0.1 |
| E | Ethyl hydroxyethyl cellulose (BERMOCOLL E230: Berol Kemi) | 0.8 | 0.8 |
| F | Methyl hydroxyethyl cellulose (TYLOSE MH300: Hoechst AG). | 1.8 | 0.1 |

The amount of cellulose ether to be employed in compositions according to the invention is from 0.05 to 5%, preferably from 0.5 to 3% by weight of the composition. We prefer to use cellulose ethers having a gel point of at least 56° C., such as at least. The gel points of polymers can be measured in a number of ways. In the present context the gel point is measured on a polymer solution prepared at 10g/l concentration in deionised water by heating 50 ml solution placed in a beaker, with stirring, at a heating rate of approximately 5° C./minute. The temperature at which the solution clouds is the gel point of the cellulose ether being tested and is measured using a Sybron/Brinkmann colorimeter at 80% transmission/450nm.

Other Optional Detergent Active Compounds

Optionally present additional detergent active compounds can be selected from anionic, and other nonionic detergent active compounds, zwitterionic and amphoteric and amphoteric synthetic detergent active compounds. Many suitable detergent compounds are commercially available and are fully described in the literature, for example in "Surface Active Agents and Detergents", Volumes I and II, by Schwartz, Perry and Berch.

Examples of such synthetic anionic detergent active compounds which optionally can be used are water-soluble alkali metal salts of organic sulphates and sulphonates having alkyl radicals containing from 8 to 22 carbon atoms, the term alkyl being used to include the alkyl portion of higher acyl radicals. Examples of suitable synthetic anionic detergent compounds are sodium and potassium alkyl sulphates, especially those obtained by sulphating higher ($C_8$–$C_{18}$) alcohols produced for example from tallow or coconut oil, sodium and potassium alkyl ($C_9$–$C_{20}$) benzene sulphonates, particularly sodium linear secondary alkyl ($C_{10}$–$C_{15}$) benzene sulphonates; sodium alkyl glyceryl ether sulphates, especially those ethers of the higher alcohols derived from tallow or coconut oil and synthetic alcohols derived from petroleum; sodium coconut oil fatty monoglyceride sulphates and sulphonates; sodium and potassium salts of sulphuric acid esters of higher ($C_8$–$C_{18}$) fatty alcohol-oxide, particularly ethylene oxide, reaction products; the reaction products of fatty acids such as coconut fatty acids esterified with isethionic acid and neutralised with sodium hydroxide; sodium and potassium salts of fatty acid amides of methyl taurine; alkane monosulphates such as those derived by reacting alpha-olefins ($C_8$–$C_{20}$) with sodium bisulphate and those derived from reacting paraffins with $SO_2$ and $Cl_2$ and then hydrolysing with a base to produce a random sulphonate; and olefin sulphonates, which term is used to describe the material made by reacting olefins, particularl $C_{10}$–$C_{20}$ alpha-olefins, with $SO_3$ and then neutralising and hydrolysing the reaction product. The preferred anionic detergent compounds are sodium ($C_{11}$–$C_{15}$) alkyl benzene sulphonates and sodium ($C_{16}$–$C_{18}$) alkyl sulphates.

Examples of other suitable nonionic detergent active compounds that optionally can be employed in the detergent composition in addition to the ethoxylated fatty alcohols, as hereinbefore defined, are alkyl ($C_6$–$C_{22}$) phenols-ethylene oxide condensates, generally with 5 to 25 units of ethylene oxide per molecule, the condensation products of aliphatic ($C_{8-18}$) primary or secondary linear or branched alcohols with ethylene oxide, with 25 to 40 units of ethylene oxide per molecule and products made by condensation of ethylene oxide with the reaction products of propylene oxide and ethylenediamine. Other nonionic detergent compounds include long chain tertiary amine oxides, long chain tertiary phosphine oxides and dialkyl sulphoxides. Mixtures of such nonionic detergent active compounds can also be employed.

Mixtures of detergent compounds, for example mixed anionic, or mixed anionic and nonionic compounds may be used in the detergent compositions, particularly the latter case to provide controlled low sudsing properties. This is beneficial for compositions intended for use in suds-intolerant automatic washing machines.

Amphoteric or zwitterionic detergent compounds can optionally also be used in the compositions of the invention but this is not normally desired due to their relatively high cost. If any amphoteric or zwitterionic detergent compounds are used it is generally in small amounts in compositions based on the much more commonly used synthetic anionic and/or nonionic detergent compounds.

The amount of other detergent active compounds can form from 5 to 50% by weight of the detergent composition.

Optional Builder

The detergent composition according to the invention can optionally comprise a detergency builder, which can be an inorganic builder salt, or an organic builder salt in addition to the soap, which can function as a builder as well as an anionic detergent active compound.

Examples of phosphorus-containing inorganic detergency builders, when present, include the water-soluble salts, especially alkaline metal pyrophosphates, polyphosphates and phosphonates. Specific examples of inorganic phosphate builders include sodium and potassium tripolyphosphates, phosphates and hexametaphosphates.

Examples of non-phosphorus-containing inorganic detergency builders, when present, include water-soluble alkali metal carbonates, bicarbonates, silicates and crystalline and amorphous alumino silicates. Specific examples include sodium carbonate (with or without calcite seeds), potassium carbonates, sodium and potassium bicarbonates and silicates.

Examples of organic detergency builders, when present, include the alkaline metal, ammonium and substituted ammonium polyacetates, carboxylates, polycarboxylates, polyacetyl carboxylates and polyhydroxysulphonates. Specific examples include sodium, potassium, lithium, ammonium and substituted ammonium salts of ethylenediaminetetraacetic acid, nitrilotriacetic acid, oxydisuccinic acid, melitic acid, benzene polycarboxylic acids and citric acid It is to be understood that the compositions according to the invention can optionally contain other builder materials.

The amount of detergency builder when employed will depend on the nature of the builder concerned. According to one embodiment of the invention, the detergent composition is particularly designed, as has been stated earlier, for use in those geographical regions where discharge of effluent containing a high phosphate content is considered to be deleterious to the ecology of the area, and accordingly legislation may be in force or be brought into force in the future prohibiting the use of such detergent composition containing more than a certain level of phosphate. In such regions, it is accordingly preferable that such compositions are substantially free from water-soluble phosphate. Accordingly, when the detergent composition according to the invention comprises a water-soluble phosphate, the amount of that phosphate present in the composition should not exceed 10% by weight of the composition. When a detergency builder other than a water-soluble phosphate is employed, there can be present from 10 to 80% by weight of detergency builder.

Other Optional Detergent Adjuncts

Apart from the essential detergent active compounds and optional detergency builders as herinbefore described, the detergent composition according to the invention can optionally also contain any of the conventional adjuncts in the amounts in which such materials are normally empolyed in fabric washing detergent compositions. Examples of such optional adjuncts include lather boosters such as alkanolamines, particularly the monoethanolamides derived from palm kernel fatty acids and coconut fatty acids, lather depressants such as alkyl phosphate, long-chain fatty acids or soaps thereof, waxes and silicones, anti-redeposition agents such as sodium carboxymethylcellulose and cellulose ethers, oxygen-releasing bleaching agents such as sodium perborate and sodium percarbonate, per-acid bleach precursors such as tetraacetylethylenediamine (TAED), chlorine-releasing bleaching agents such as trichloroisocyanuric acid, fabric softening agents, inorganic salts, such as sodium sulphate and magnesium silicate, and in very minor amounts, fluorescent agents, perfumes, enzymes such as proteases and amylases, germicides and colourants.

It is particularly beneficial to include in the detergent compositions an amount of sodium perborate or percarbonate, preferably between 10 to 40%, preferably from 15 to 30% by weight, together with TAED.

It is particularly desirable optionally to include one or more antidepositon agents in the detergent compositions of the invention, to decrease further the tendency to form inorganic deposits on washed fabrics. The most effective antideposition agents are anionic poly electrolytes, especially polymeric aliphatic carboxylates.

The amount of any such antideposition agent can be from 0.01 to 5% by weight, preferably from 0.2 to 2% by weight of the compositions.

Specific preferred antideposition agents, if used, are the alkali metal, preferably the sodium, or ammonium, salts of homo- and co-polymers of acrylic acid or substituted acrylic acids, such as sodium polyacrylate, the sodium salt of copolymethacrylamide/acrylic acid and sodium poly-alphahydroxyacrylate, salts of copolymers of maleic anhydride with ethylene, acrylic acids, vinylmethylether allyl acetate or styrene, especially 1:1 copolymers, and optionally with partial esterification of the carboxyl groups. Such copolymers preferably have relatively low molecular weights, e.g. in the range of 1,000 to 50,000. Other antidepostion agents include the sodium salts of polyitaconic acid and polyaspartic acid, phosphate esters of ethoxylated aliphatic alcohols, polyethylene glycol phosphate esters, and certain phosphonates such as sodium ethane-1-hydroxy-1,1-diphosphonate, sodium ethylene-diamine tetramethylene phosphonate, and sodium 2-phosphonobutane tri-carboxylate. Mixtures of organic phosphonic acids or substituted acids or their salts with protective colloids such as gelatin may also be used. The most preferred antideposition agent is sodium polyacrylate having a MW of 10,000 to 50,000, for example 20,000 to 30,000.

It is generally also desirable optionally to include in the composition according to the invention an alkali metal silicate, to decrease the corrosion of metal parts in washing machines, to provide processing benefits, especially when the detergent composition is a powder, and generally to improved powder properties. The presence of such alkali metal silicates, particularly sodium ortho-, meta- or preferably neutral or alkaline silicate, at levels of at least about 1%, and preferably from 5 to 15% by weight of the composition, is advantageous. The more highly alkaline ortho- and meta- silicates would normally only be used at lower amounts within this range, in admixture with the neutral or alkaline silicates.

Product Forms of the Detergent Composition

The detergent composition according to the invention can be manufactured in the form of a powder, liquid or bar.

Process for Manufacture of Detergent Powder Composition

Detergent powder compositions according to the invention can be prepared using any of the conventional manufacturing techniques commonly used or proposed for the preparation of fabric washing detergent powder compositions. These include slurry-making followed by spray-drying or spray-cooling and subsequent dry-dosing of sensitive ingredients anot suitable for incorporation prior to a drying or heating step. Other conventional techniques, such as noodling, granulation, mixing by fluidisation in a fluidised bed, may be utilised as and when necessary. Such techniques are familiar to those skilled in the art of fabric washing detergent powder composition manufacture.

Use of the Detergent Composition

The washing process of the invention can be accomplished manually, if desired, but is normally accomplished in a domestic or commercial laundry washing machine. The latter permits the use of higher alkalinity, and more effective agitation, all of which contribute generally to better detergency. The type of washing machine used, if any, is not significant.

The detergent compositions are particularly suitable for washing fabrics at low temperatures i.e. below 50° C., even below 35° C. Successful results can also be achieved at temperatures above 50° C. The following examples illustrate the invention.

EXAMPLE 1

This example illustrates a detergent powder composition according to the invention and provides comparative data with similar but different compositions in order to highlight the criticality of the soap, nonionic detergent active compound and cellulose ether which comprise the compositions according to the invention.

A detergent powder composition according to the invention had the following formulation:

| | Parts by weight |
|---|---|
| Soap | |
| tallow soap | 35 |
| Nonionic detergent active compound | |
| $C_{13}$ to $C_{15}$ fatty alcohol 7EO (SYNPERONIC-7) | 12 |

-continued

| | Parts by weight |
|---|---|
| Cellulose ether | |
| methyl hydroxyethyl cellulose (TYLOSE MH300)* | 1 |
| Other ingredients | |
| sodium silicate | 8 |
| sodium sulphate | 15 |
| sodium perborate tetrahydrate | 20 |

*Gel point 58° C.

The efficacy of the above composition was examined using a standard washing procedure followed by a reflectance measurement as a measure of soil redeposition, if any, that had occurred This test was conducted as follows:

Standard soiled test cloths carrying a mixture of fatty and particulate soil were washed at 60° C. in 30° FH water in a Tergometer pot, together with clean pieces of combed cotton and polyester (Crimplene), with a soap-built composition dosed at 4g per litre from made-up solutions. Redeposition onto these initially clean fabrics was measured as the loss in reflectance ($-\Delta R_{460}$) over 5 repeated washes.

Seven other formulations in which other conventional anti-redeposition agents were compared with the cellulose ether, or in which an anionic non-soap detergent active compound replaced the nonionic detergent active compound were prepared, and each was assessed according to the above test in order to determine its ability to limit redeposition of soil from the wash liquor.

As with the detergent powder composition according to the invention as set out above, each comparative formulation contained similar quantities of tallow soap, silicate, sulphate and perborate.

The ingredient variation in these seven comparative formulae are shown below together with the loss in reflectance measurement with Crimplene and with cotton in each case, compared with these measurements obtained with the composition according to the invention.

| | $-\Delta R$ (Crimplene) | $-\Delta R$ (Cotton) |
|---|---|---|
| EXAMPLE 1 - formulation as above: i.e. with SYNPERONIC 12 parts + TYLOSE 1 part | 0.4 | 4.8 |
| Comparative examples | | |
| 1. DOBS 12 parts | 6.6 | 13.3 |
| 2. DOBS 12 parts + SCMC 1 part | 5.1 | 11.7 |
| 3. DOBS 12 parts + TYLOSE 1 part | 3.6 | 10.7 |
| 4. DOBS 12 parts + CPA11 1 part | 8.1 | 11.8 |
| 5. SYNPERONIC 12 parts | 2.9 | 12.4 |
| 6. SYNPERONIC 12 parts + SCMC 1 part | 2.4 | 11.1 |
| 7. SYNPERONIC 12 parts + CPA11 1 part | 9.1 | 11.4 |

DOBS is dodecylbenzene sulphonate anionic detergent active compound
SCMC is sodium carboxymethyl cellulose
CPA11 is a polyacrylate anti-redeposition agent.

The above results confirm that the combination of TYLOSE MH300 and SYNPERONIC 7 provides the most effective combination for reducing redeposition of soil from a composition in which soap forms a major detergent active compound. Thus, soil redeposition is virtually eliminated when the composition according to the invention is used for washing Crimplene, and is low compared with the comparative formulations when used for washing cotton. The above results also show that TYLOSE is more effective than the traditional anti-redeposition agents sodium carboxymethyl cellulose and the polyacrylate CPA11.

I claim:

1. A detergent composition for washing soiled fabrices without undue redeposition of soil and without the use of substantial amounts of phosphate builders, said composition comprising:

(i) from 20 to 50% by weight of a soap selected from water-soluble alkali metal salts of $C_8$–$C_{26}$ fatty acids;

(ii) from 5 to 25% by weight of a nonionic detergent active compound selected from ethoxylated $C_7$–$C_{22}$ primary and secondary alcohols, the weight ratio of said soap to said nonionic detergent active compound being from 1:1 to 10:1;

(iii) from 0.05 to 5% by weight of a cellulose ether selected from alkyl/hydroxyalkyl cellulose dervicatives in which the average number of substituent groups per anhydroglucose unit is from 1.5 to 3.0, the alkyl substituent groups containing 1 to 4 carbon atoms and the hydroxyalkyl groups containing 2 to 4 carbon atoms wherein the degree of substitutiton of alkyl groups is from about 0.8 to about 1.9 and the degree of substititution of hydroxyalkyl groups is from about 0.1 to about 1.0 per anhydroglucose unit; and (iv) from 0 to 10% by weight of a phosphate builder selected from water-soluble alkali metal pyrophosphates, polyphosphates and phosphonates, said percentages being by weight of the overall composition, and said composition being free of other synthetic surfactants.

2. A composition according to claim 1, in which the nonionic detergent active compound is a straight or branched chain $C_7$ to $C_{20}$ primary or secondary alcohol ethoxylated with from 5 to 25 moles of ethylene oxide per mole of alcohol.

3. A composition according to claim 1, in which the amount of nonionic detergent active compound is from 7 to 15% by weight of the composition.

4. A composition according to claim 1, in which the weight ratio of soap to nonionic detergent active compound is from 2:1 to 5:1.

5. A composition according to claim 1, in which the cellulose ether is a methyl hydroxyethyl cellulose.

6. A composition according to claim 1, in which the amount of the cellulose ether is from 0.5 to 3% by weight of the composition.

* * * * *